US010633237B2

(12) United States Patent
Cocchi

(10) Patent No.: US 10,633,237 B2
(45) Date of Patent: Apr. 28, 2020

(54) SYSTEM AND METHOD FOR FILLING A CONTAINER WITH A POURABLE PRODUCT

(75) Inventor: Enrico Cocchi, Parma (IT)

(73) Assignee: SIDEL S.P.A. CON SOCIO UNICO, Parma (ID)

( * ) Notice: Subject to any disclaimer, the term of this patent is extended or adjusted under 35 U.S.C. 154(b) by 282 days.

(21) Appl. No.: 13/995,344

(22) PCT Filed: Dec. 19, 2011

(86) PCT No.: PCT/IB2011/055795
§ 371 (c)(1),
(2), (4) Date: Aug. 29, 2013

(87) PCT Pub. No.: WO2012/085828
PCT Pub. Date: Jun. 28, 2012

(65) Prior Publication Data

US 2013/0333800 A1 Dec. 19, 2013

(30) Foreign Application Priority Data

Dec. 23, 2010 (IT) ..... TO2010A1052

(51) Int. Cl.
*B67C 3/00* (2006.01)
*B67C 3/20* (2006.01)

(52) U.S. Cl.
CPC ..... *B67C 3/007* (2013.01); *B67C 3/20* (2013.01)

(58) Field of Classification Search
CPC ..... B67C 3/007; B67C 3/20; B67C 3/286; B67D 3/0041; F16K 3/26; F16K 31/086
USPC ..... 141/192; 73/861.52, 861.64
See application file for complete search history.

(56) References Cited

U.S. PATENT DOCUMENTS 1,759,239 A * 5/1930 Morrison ..... G01F 1/372 73/861.52
3,545,492 A * 12/1970 Scheid ..... F16L 55/02718 138/42
3,776,033 A * 12/1973 Herzl ..... G01F 1/3236 73/861.22

(Continued)

FOREIGN PATENT DOCUMENTS

DE 3937630 A1 6/1990
DE 102008018089 A1 10/2009

(Continued)

OTHER PUBLICATIONS

"International Application Serial No. PCT/IB2011/055795, International Search Report dated Apr. 27, 2012".

(Continued)

*Primary Examiner* — Timothy L Maust
*Assistant Examiner* — James R Hakomaki
(74) *Attorney, Agent, or Firm* — Finnegan, Henderson, Farabow, Garrett & Dunner, LLP

(57) ABSTRACT

A filling system for filling a container with a pourable product, in particular a pourable product having an electrical conductivity below 15 μS, comprising: a tank filled, in use, with a pourable product; at least one filling valve selectively available in a configuration in which it allows the filling of the container with the pourable product; and at least one duct interposed between the tank and the filling valve; the system comprises a vortex flowmeter interposed along the duct.

19 Claims, 4 Drawing Sheets

(56) References Cited

U.S. PATENT DOCUMENTS

| | | | | | |
|---|---|---|---|---|---|
| 4,181,020 | A * | 1/1980 | Herzl | G01F 1/3263 | 73/861.24 |
| 4,365,518 | A * | 12/1982 | Zacharias, Jr. | G01F 1/662 | 73/861.31 |
| 4,841,781 | A * | 6/1989 | Khalifa | G01F 1/32 | 73/861.22 |
| 4,949,764 | A * | 8/1990 | Clusserath | B67C 3/286 | 141/6 |
| 4,970,902 | A * | 11/1990 | Misumi | G01F 1/662 | 73/861.23 |
| 5,285,825 | A * | 2/1994 | Townsley | B65B 3/28 | 141/104 |
| 5,398,548 | A * | 3/1995 | Ono | G01F 1/3209 | 73/202 |
| 5,922,970 | A * | 7/1999 | Ohle | G01F 1/3218 | 138/37 |
| 5,938,425 | A * | 8/1999 | Damrath | F23N 1/005 | 126/39 E |
| 6,097,993 | A | 8/2000 | Skupin et al. | | |
| 6,189,578 | B1 * | 2/2001 | Clusserath | B67C 3/10 | 141/293 |
| 6,752,027 | B1 * | 6/2004 | Kalinoski | G01F 1/3245 | 73/861.22 |
| 7,866,123 | B2 * | 1/2011 | Clusserath | B67C 3/22 | 141/144 |
| 2002/0000259 | A1 | 1/2002 | Suzuki et al. | | |
| 2002/0179177 | A1 * | 12/2002 | Tsukano et al. | 141/57 | |
| 2005/0092101 | A1 * | 5/2005 | Bengtson | G01F 1/3209 | 73/861.22 |
| 2008/0216810 | A1 * | 9/2008 | Clauss | F23N 1/005 | 126/42 |
| 2008/0312594 | A1 * | 12/2008 | Urich | A61M 1/0031 | 604/149 |
| 2010/0000182 | A1 * | 1/2010 | Clusserath | 53/284.5 | |
| 2010/0070095 | A1 * | 3/2010 | Inagaki | G01F 1/6842 | 700/282 |
| 2010/0192521 | A1 * | 8/2010 | Clusserath | 53/473 | |
| 2011/0061469 | A1 * | 3/2011 | Maahs | 73/861.22 | |

FOREIGN PATENT DOCUMENTS

| | | | |
|---|---|---|---|
| EP | 0038258 | A1 | 10/1981 |
| EP | 0844547 | A1 | 5/1998 |
| JP | H011-36024 | A | 5/1989 |
| JP | 11-342994 | A | 12/1999 |
| JP | H11-342994 | A | 12/1999 |
| JP | 2006-248547 | A | 9/2006 |
| WO | WO-2012/085828 | A1 | 6/2012 |

OTHER PUBLICATIONS

"International Application Serial No. PCT/IB2011/055795, Written Opinion dated Apr. 27, 2012", 6 pgs.

Affidavit by Dr. Rer. Nat. Rainer Höcker (project manager in the development of vortex flowmeters at Endress+Hauser Flowtec AG since Jan. 2001) (with English Translation), 5 p.

Writ of Opposition dated May 4, 2016 by Endress+Hauser Flowtec AG, Reinach, Switzerland to patent in suit EP 2 655245 B1 System and Method for Filling a Container (Sidel S.p.A. Con Socio Unico) (with English Translation), 47 pgs.

"Electromagnetic Flow Measuring System "Dosimag": volume flow measuring system for filling applications", Technical Information TI 066D/06/en, Endress+Hauser, Weil am Rhein, Germany, (2004), p. 1-5, 10-12.

"Operating Instructions: Rosemount Series 88000 Smart Vortex Flow Meter", 00809-0105-4004, Rev AA, Emerson Process Management (in German with English Translation), p. A-5.

"VDI/VDE Guidelines: Vortex meter for volume and flow measurement", VDI/VDE Handbook Measurement Technology #2643, VDI/VDE Society for Measurement and Automation Technology, Verein Deutscher Ingenieure, Dusseldorf, Jan. 1993 (with English Translation), p. 9.

Bluml, S., et al., Handbuch der Fulltechnik, Kronseder, V. (ed.), Behr's Verlag, Hamburg (2004), ISBN: 3-89947-089-3 (with English Translation), p. 262, 280-282, 340-344, 450-451.

* cited by examiner

SYSTEM AND METHOD FOR FILLING A CONTAINER WITH A POURABLE PRODUCT

RELATED APPLICATIONS

This application is a U.S. National Stage Filing under 35 U.S.C. 371 from International Application No. PCT/IB2011/055795, filed on Dec. 19, 2011, and published as WO 2012/08528 A1 on Jun. 28, 2012, which claims priority to Italian Patent Application Serial No. TO2010A001052, filed on Dec. 23, 2010; which application and publication are incorporated herein by reference in their entirety.

TECHNICAL FIELD

The present invention relates to a system and method for filling a container with a pourable product.

In particular, the present invention relates to a system and method for filling a container with a pourable food product.

More in particular, the present invention relates to a system and method for filling a container with a pourable food product having an electrical conductivity below 15 μS, for example osmotised water i.e. water subjected to an inverse osmosis process to reduce the concentration of dissolved salts as much as possible.

BACKGROUND ART

Filling systems incorporated in bottling machines and defining respective filling stations are known.

More precisely, the filling station is fed with empty containers and provides containers filled with the pourable food product.

The filling station substantially comprises a carousel conveyor rotating about a rotation axis, a tank containing the pourable food product and positioned on the carousel or externally thereto, and a plurality of filling valves which are fluidically connected with the tank and are supported by the carousel conveyor in a radially external position with respect to the rotation axis of the carousel conveyor.

In greater detail, the valves are displaceable between respective open positions in which they allow the flow of pourable product within the respective containers, and respective closed positions in which they prevent the pourable product from flowing within the respective containers.

The carousel conveyor is provided with a plurality of support elements for the containers provided to arrange container filling mouths in positions below the respective valves and handle the containers along an arc-shaped path about said rotation axis integrally with the respective valves.

The tank is fluidically connected with the filling valves by means of a plurality of ducts, along each of which magnetic flowmeters are interposed to measure, when the respective filling valves are arranged in open positions, the flow rates of fluid by which the containers are filled.

The measurement of the flow rate performed by the magnetic flowmeters is used to control the movement of the filling valves between the respective open and closed positions, so as to fill the containers with a desired amount of pourable food product.

In greater detail, the magnetic flowmeters create a magnetic field in a direction radial to the axis of the duct and detect an output voltage proportional to the speed and, therefore, to the flow rate of the pourable product.

More precisely, the pourable product has an own electric conductivity, substantially due to the fact that it contains dissociated ions, and therefore gives rise to electric currents when it passes through the magnetic field generated by the electric conductivity flowmeter.

These currents are detected by means of a voltage measurer, which inevitably varies the measurement of the flow rate performed by the flowmeter mainly due to its internal resistances generating a measurement error.

Recently, the need has developed in the sector for containers filled with osmotised water, i.e. water substantially free of dissolved salts and having a very low electric conductivity, for example lower than 15 μS.

The Applicant has noted that when the electric conductivity of the pourable product reaches such low values, the measurement error introduced by the magnetic flowmeter in the measurement of the flow rate is particularly relevant and sometimes on the same order of magnitude of the flow rate.

Therefore, the measurement of the flow rate performed by the flowmeter results in these cases poorly reliable, generating problems in the precision and in the repeatability of the filling of the container.

The need is felt for measurements of the flow rates of pourable products with especially low electric conductivity, such as for example osmotised water, in a simple and cost-effective manner and reducing the presence of mobile parts as much as possible.

OVERVIEW

Examples of the present subject matter provide a filling system to fill a container with a pourable product, which allows to satisfy the above said need in a simple and cost-effective manner.

This is achieved by the present subject matter as it relates to a filling system of a container with a pourable product, in particular a pourable product having an electric conductivity below 15 μS, according to claim 1.

The present subject matter also relates to a method for filling a container with a pourable product, in particular a pourable product having an electric conductivity below 15 μS, according to claim 10.

BRIEF DESCRIPTION OF THE DRAWINGS

An embodiment is hereinafter disclosed for a better understanding of the present subject matter, by mere way of non-limitative example and with reference to the accompanying drawings, in which.

BEST MODE FOR CARRYING OUT THE INVENTION

Figure 1:
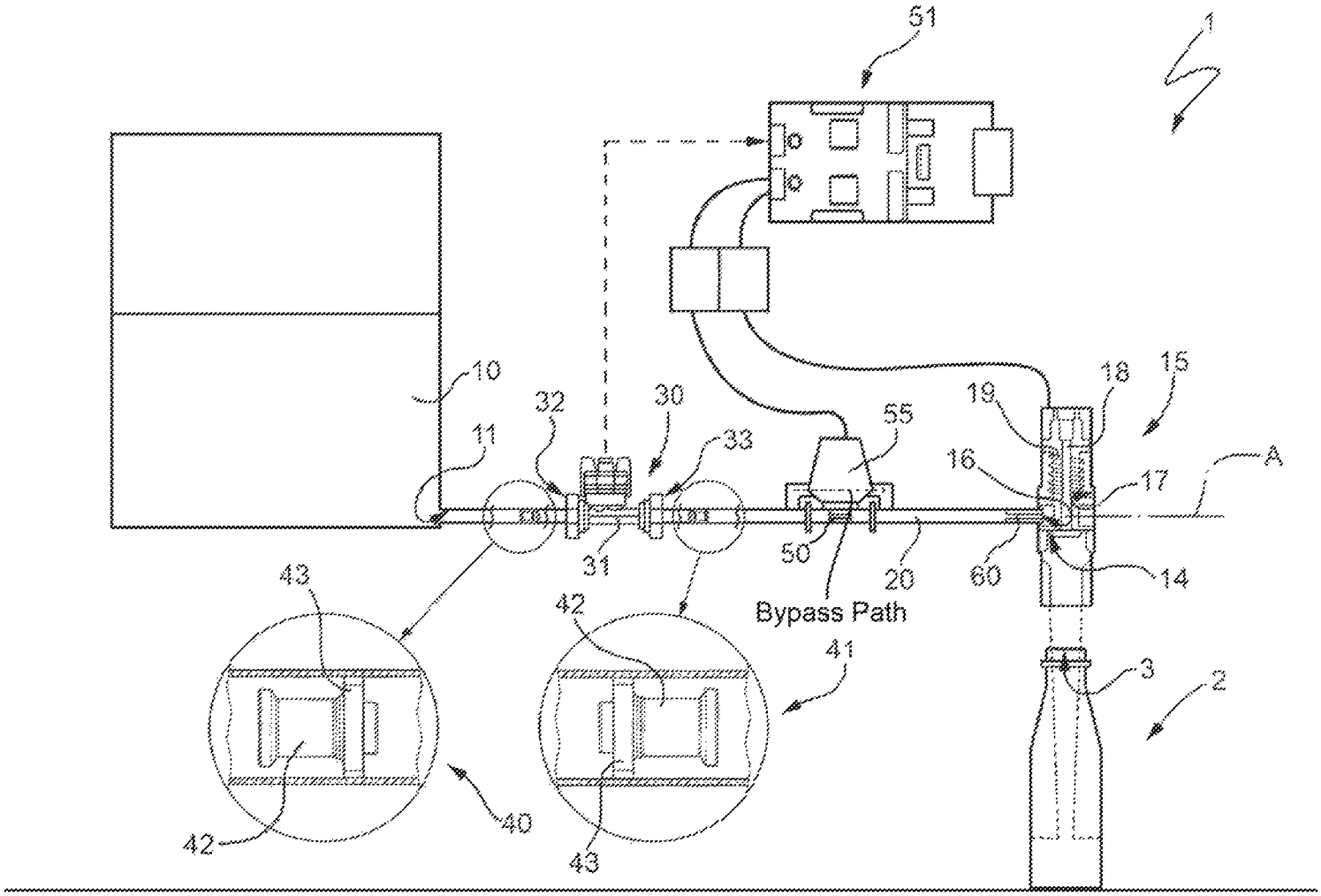
FIG. 1 diagrammatically shows a system for filling containers with pourable products made according to the dictates of the present subject matter.

With particular reference to the accompanying figures, numeral 1 indicates a filling system for filling containers 2 with a pourable product and adapted to be incorporated in a filling machine which is not shown in detail.

In greater detail, the pourable product has an electric conductivity lower than 15 μS.

More in particular, the pourable product is a food product and could be osmotised water, i.e. water subjected to an inverse osmosis process and therefore substantially free of dissolved salts.

System 1 substantially comprises:

- a tank 10 filled with a pourable product at a given pressure, for example at a pressure in the range between 0.6 and 1.4 bars;
- a plurality of filling valves 15 (only one of which shown in FIG. 1) adapted to fill respective containers 2 with the pourable product; and
- a plurality of ducts 20 (one of which shown in FIG. 1) extending along respective axes A, interposed between an outlet mouth 11 of the tank 10 and an inlet mouth 16 of the corresponding filling valve 15.

Filling valves 15 protrude from a carousel (not shown) that rotates about a vertical axis and forming part of the filling machine.

Filling valves 15 each comprise a hollow housing 17 defining inlet mouth 16 and a shutter element 18 that slides parallelly to the vertical axis within housing 17.

Shutter element 18 of each filling valve 15 may be displaced between a closed position (shown in FIG. 1) in which it prevents pourable product from flowing from respective duct 20 to respective container 2 by means of an opening 14, and an open position in which it allows the pourable product to flow from respective duct 20 to respective container 2.

Each filling valve 15 further comprises a spring 19, in this case a helicoidal spring having a vertical axis, interposed between shutter element 18 and housing 17. In particular, each spring 19 is wound on respective shutter element 18 and loads respective shutter element 18 towards the open position.

Containers 2 are also rotated integrally with the carousel conveyor during a filling step, so that respective mouths 3 are arranged below respective filling valves 15.

Advantageously, system 1 comprises a plurality of vortex flowmeters 30 interposed along respective ducts 20.

Vortex flowmeters 30 are adapted to detect, when respective filling valves 15 are arranged in respective open positions, the flow rates of pourable product that pass through respective ducts 20, so as to provide respective information associated to the amounts of pourable product by which respective containers 2 have been filled.

In particular, vortex flowmeters 20 exploit the precession of the vortexes of Kalman.

The following disclosure will refer for simplicity to a single duct 20, a single vortex flowmeter 30 and a single filling valve 15.

Vortex flowmeter 30 comprises (FIGS. 2 and 4):

- a main tubular body 31 defining an inlet mouth 32 and an outlet mouth 33 through which duct 20 passes;
- an obstacle 36 having a trapezoidal axial section, inserted in the main body 31 and defining an impact surface 34 orthogonal to axis A of duct 20; and
- a sensor 35 arranged downstream of obstacle 36 proceeding from inlet mouth 32 towards outlet mouth 33.

Obstacle 36 extends symmetrically with respect to axis A.

In particular, the pourable product fed in inlet mouth 32 impacts against surface 34 of obstacle 36, producing a train of vortexes 39, the frequency of which is proportional to the speed of the pourable product within duct 20.

Sensor 35 detects the frequency of vortexes 39 and generates an impulsive electric signal associated to this frequency and therefore to the speed and flow rate of the pourable product in duct 20.

System 1 further comprises, proceeding from tank 10 towards filling valve 15 (FIG. 1):

- a first lineariser device 40 for linearising the flow of the pourable product and arranged downstream of the inlet mouth 32 of the vortex flow meter 30;
- a second lineariser device 41 for linearising the flow of the pourable product and arranged downstream of the outlet mouth 32 of the vortex flow meter 30;
- a second throttling 50;
- a valve 55 displaceable between a first position in which it allows the pourable product to bypass throttling 50 and a second position in which it forces the pourable product to pass through throttling 50; and
- a first throttling 60 arranged immediately upstream of filing valve 15

Device 40 is adapted to make the flow of the pourable product as laminated as possible upstream of vortex flowmeter 30. Thereby, the measurement performed by vortex flowmeter 30 is not disturbed by the possible turbulent flow of the pourable product not generated by the impact thereof against obstacle 36.

Device 41 is adapted to make the flow of the pourable product as laminated as possible downstream of vortex flowmeter 30. Thereby, the turbulences of the flow of the pourable product downstream of vortex flowmeter 30 do not disturb the operation of vortex flowmeter 30.

Figure 2:
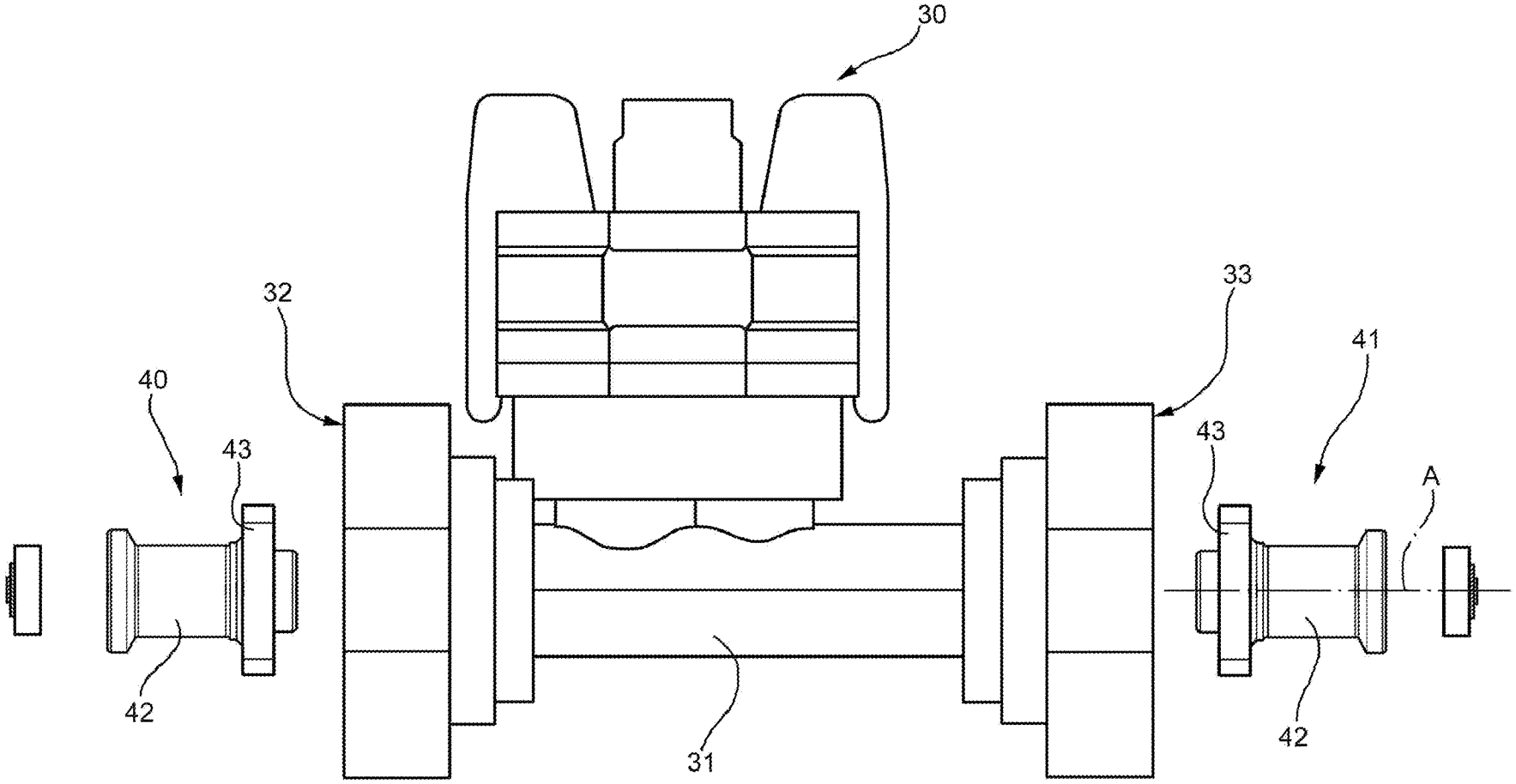
FIG. 2 shows an enlarged exploded view of some components of the system of FIG. 1.

With reference to FIGS. 1 and 2, devices 40, 41 are housed within respective portions of duct 20 arranged respectively upstream and downstream of vortex flowmeter 30.

Each device 40, 41 further comprises:

- a main body 42 arranged coaxially to duct 20; and
- a disc 43 radially projecting from main body 42, defining a plurality of openings 44 through which a pourable product passes, and having an external diameter thereof cooperating with an inner side surface of duct 20.

Devices 40, 41 are mounted symmetrically with respect to vortex flowmeter 30.

Figure 3:
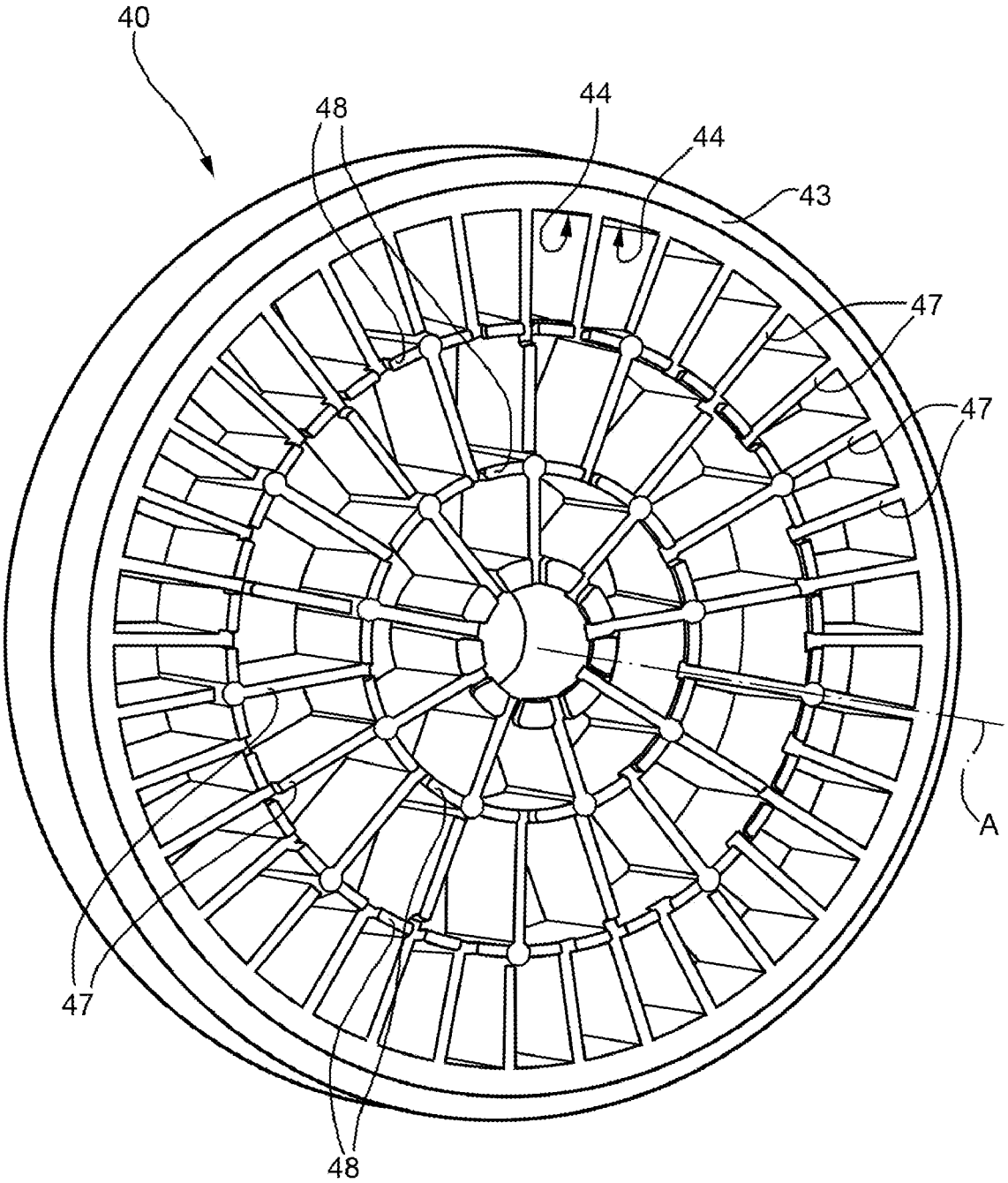
FIG. 3 shows another detail of FIG. 2 in a particularly enlarged perspective view.

In particular, disc 43 comprises (FIG. 3) a plurality of walls 47 which are radial to axis A, and a plurality of walls 48 configured as circumferences and intersecting walls 47 (FIG. 3).

Each opening 44 is open parallelly to axis A, is radially defined by respective segments of two sequential walls 48 and is defined circumferentially by respective segments of two sequential walls 47.

Discs 43 are arranged near respective axial ends of respective main bodies 42.

More precisely, disc 43 of device 40 is arranged at an axial end of main body 42, which is nearest to inlet mouth 32 of vortex flowmeter 30.

Disc 43 of device 41 is arranged at an axial end of main body 42, which is nearest to inlet mouth 33 of vortex flowmeter 30.

With reference to a condition in which filling valve 15 is in an open position, valve 55 allows a high speed filling of the container at a first filling rate when arranged in the first position and a low speed filling of the container at a second filling rate when arranged in the second position.

As a matter of fact, when valve 55 is arranged in the second position, the pourable product passes through throttling 50, which reduces the flow rate thereof.

Throttling 60 is adapted to reduce the maximum flow rate fed to filling valve 15 when valve 55 is arranged in the first position, and to increase the pressure downstream of vortex flow meter 30 so as to avoid cavitation phenomena of the pourable product within duct 20.

Throttlings 50, 60 are configured as hollow cylinders coaxial to duct 20.

The diameter of throttling 60 can be greater than the diameter of throttling 50.

In the case shown, duct 20 and vortex flowmeter 30 are dimensioned so that the pressure at outlet mouth 33 is at least 5 times the hydraulic head of the pourable product between inlet mouth 32 and outlet mouth 33.

More precisely, duct 20 and vortex flowmeter 30 are dimensioned so that the pressure at inlet mouth 32 is at least 5.5 times the hydraulic head of the pourable product between inlet mouth 32 and outlet mouth 33.

System 1 further comprises a control unit 51 inputted with a measurement of the flow rate of the pourable food product detected by vortex flowmeter 30, and adapted to control valve 55 and filling valve 15.

The filling machine comprises the carousel conveyor and a plurality of systems 1.

In a first embodiment, the filling machine comprises a single tank 10 connected to all ducts 20 of respective systems 1 and arranged externally to the carousel.

In a second embodiment, tank 10 is connected to all ducts 20 of respective systems 1 and is arranged internally to the carousel conveyor.

The operation of system 1 is disclosed with reference to a single duct 20, a single vortex flowmeter 30, a single valve 55 and a single filling valve 15.

When container 2 is to be filled, control unit 51 arranges filling valve 15 in the open position.

Furthermore, control unit 51 arranges valve 55 in the first position in case of high speed filling and in the second position in case of low speed filling.

Indeed, in the case of high speed filling, valve 55 moves the pourable product along a path in which it bypasses throttling 50.

Differently, in the case of low speed filling, valve 55 forces the pourable product to pass through throttling 50, determining a reduction in the filling speed of container 2.

The pourable product moves in duct 20 from tank 10 towards filling valve 15, passing through, in a sequence:

device 40:

vortex flowmeter 30;

device 41:

valve 55; and throttling 60.

More precisely, the flow of the pourable product is made as laminar as possible by device 40, in virtue of the presence of openings 44.

Thereby, possible turbulences of the flow of the pourable product which are not caused by the interaction with obstacle 36 do not disturb the measurement of vortex flowmeter 30.

Figure 4:
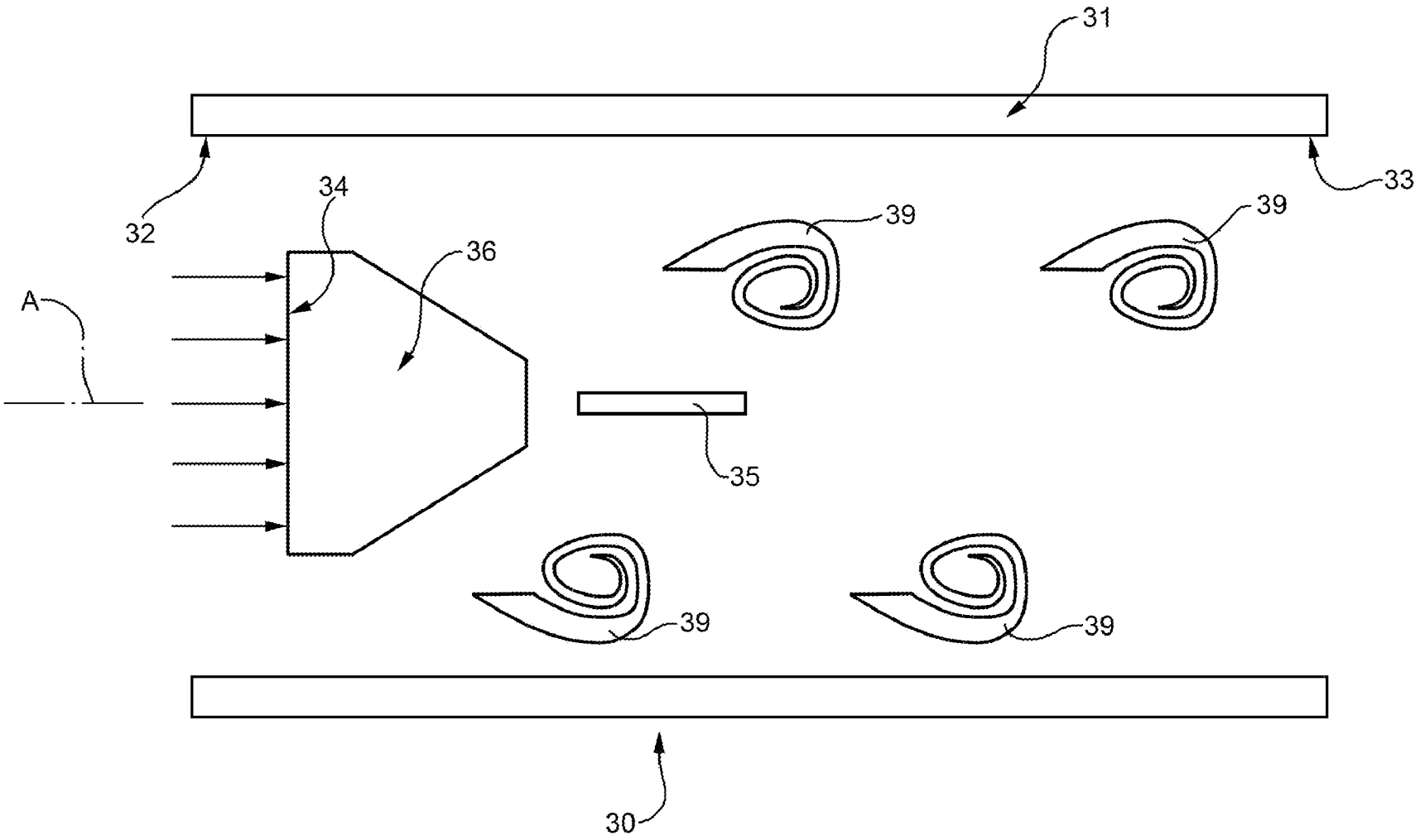
FIG. 4 shows a particularly enlarged view of some details in FIG. 2.

Subsequently, the pourable product passes through inlet mouth 32 and impacts against obstacle 36 generating vortexes 39 (FIG. 4).

Sensor 35 detects the frequency of vortexes 39 and generates a pourable product flow rate signal proportional to the above said frequency of vortexes 39.

Control unit 51 is inputted with this flow rate signal and uses it to control filling valve 15 and valve 55.

More precisely, control unit 51 controls filling valve 15 and valve 55 so that container 2 is filled with a given amount of pourable product and at a given filling speed.

After having interacted with obstacle 36 and sensor 35, the pourable product passes through outlet mouth 33 and reaches device 41.

In virtue of openings 44, device 41 makes the flow of the pourable product downstream of vortex flowmeter 30 as laminar as possible.

Therefore, possible turbulences downstream of vortex flowmeter 30 do not disturb the measurement of the flow rate performed by vortex flowmeter 30.

Subsequently, the pourable product passes through or does not pass through throttling 50 depending on whether valve 55 is arranged in the second or in the first position.

Downstream of valve 55, the pourable product passes through throttling 60, which is effective in reducing the maximum flow rate passing through valve 55 in high speed filling conditions and maintains at a minimum value the pressure downstream of vortex flowmeter 30, preventing the occurrence of cavitation phenomena within vortex flowmeter 30.

Subsequently, the pourable product passes through inlet mouth 16 and opening 14, and fills container 2.

At the end of the filling step, filling valve 15 is returned to the closed position by spring 19.

From an analysis of the features of system 1 and of the method according to the present invention, the advantages it allows to obtain are apparent.

In particular, system 1, in virtue of the presence of vortex flowmeter 30, allows to measure the flow rate of the pourable product within duct 20 in the step of filling container 2, independently of the electric conductivity of the pourable product.

Indeed, the precision and accuracy of vortex flowmeter are not affected by the electric conductivity of the pourable product, contrary to what happens with magnetic flowmeter discloses in the introduction of the present disclosure.

The consequence is that system 1 allows to fill containers 2 with a high precision even with a pourable product having an electric conductivity below 15 μS, such as for example osmotised water.

Furthermore, in virtue of the fact that vortex flowmeter 30 does not require moving parts, system 1 results particularly cost-effective to implement and simple to maintain.

The presence of devices 40, 41 allows to avoid that possible turbulences of the flow of the pourable product both upstream and downstream of vortex flowmeter 30 disturb the precision of the measurement of the flow rate performed by vortex flowmeter 30.

The consequence is that devices 40, 41 considerably increase the repeatability of the measurement of the flow rate performed by vortex flowmeter 30.

In particular, the configuration of openings 44 symmetrical with respect to axis A allows to make the flow of pourable product inputted in vortex flowmeter 30 symmetrical with respect to axis A.

Thereby, possible distortions generated by dissymmetries in duct 20 do not disturb the measurement of vortex flowmeter 30.

Throttling 60 reduces the maximum flow rate passing through valve 55 in high speed filling conditions and maintains the pressure downstream of vortex flowmeter 30 at a minimum value, avoiding the occurrence of cavitation phenomena within vortex flowmeter 30.

Finally, system 1 comprises a filling valve 15, which is exclusively dedicated to filling container 2 while it employs valve 55 to select the filling speed.

The consequence is that the filling of container 2 is highly repeatable, independently of the speed of the filling.

Finally, it is clear that modifications and variants not departing from the scope of protection of the claims can be made to system 1 and to the filling method disclosed and shown herein.

The invention claimed is:

1. A filling system for filling a container with a pourable product having electrical conductivity below 15 μS, the filling system comprising:

a tank configured to hold the pourable product at a tank pressure between 0.6 bars and 1.4 bars;

a filling valve configured to selectively allow filling of the container with the pourable product;

a control unit configured to control opening of the filling valve;

a duct interposed between the tank and the filling valve;

a vortex flowmeter disposed within the duct, the vortex flowmeter comprising:

an inlet mouth, an outlet mouth, at least one obstacle situated between the inlet mouth and outlet mouth, the obstacle configured to create a train of vortices in the pourable product flowing through the duct, and a sensor located downstream of the obstacle and configured to detect the frequency of the vortices created by the obstacle; and a pressure enhancing element interposed within the duct downstream of the outlet mouth of the vortex flowmeter and upstream of the filling valve, the pressure enhancing element configured to force the pourable product through a pressure enhancing element diameter that is smaller than a diameter of the duct, wherein the tank pressure, the pressure enhancing element, and the duct are configured to create a pressure at the outlet mouth of the vortex flowmeter that is at least 5 times greater than a hydraulic head between the inlet and outlet mouths of the vortex flowmeter, and wherein the control unit is configured to:

while the pourable product having the electrical conductivity below 15 μS flows through the vortex flowmeter having the pressure at the outlet mouth thereof that is at least 5 times greater than the hydraulic head between the inlet and outlet mouths thereof, calculate a flow rate of the pourable product based on the frequency of the vortices in the pourable product detected by the sensor, and control opening of the filling valve based on the calculated flow rate of the pourable product.

2. The filling system according to claim 1, further comprising:

a first lineariser device disposed within the duct at a position upstream of the vortex flowmeter; and a second lineariser device disposed within the duct at a position downstream of the vortex flowmeter.

3. The filling system according to claim 2, wherein at least one of the first lineariser device or the second lineariser device includes a plurality of openings arranged symmetrically about an axis of the duct.

4. The filling system according to claim 1, further comprising:

a throttling disposed within the duct between the vortex flowmeter and the pressure enhancing element, the throttling configured to force the pourable product flowing along the duct through a diameter of the throttling that is smaller than the diameter of the duct; and a bypass valve configured to be displaced between:

a first position, in which the bypass valve is configured to guide the pourable product to pass through the pressure enhancing element and to bypass the throttling so as to fill the container with the pourable product at a first filling rate, and a second position, in which the bypass valve is configured to force the pourable product to pass through the pressure enhancing element and to pass through the throttling so as to fill the container with the pourable product at a second filling rate, wherein the first filling rate is greater than the second filling rate, and wherein when the bypass valve is arranged in the second position, the pressure enhancing element is configured to maintain the flow rate of the pourable product through the throttling to be equal to or less than a maximum flow rate.

5. The filling system according to claim 4, wherein the pressure enhancing element and the throttling are cylindrical, and wherein the diameter of the pressure enhancing element is greater than the diameter of the throttling.

6. The filling system according to claim 1, wherein the pressure enhancing element is a throttling situated between the vortex flowmeter and the filling valve.

7. A method for filling a container with a pourable product having an electrical conductivity below 15 μS and contained in a tank, wherein the tank is connected to a filling valve via a duct having a vortex flowmeter and is configured to hold the pourable product at a tank pressure between 0.6 bars and 1.4 bars, the duct including a pressure enhancing element downstream of the vortex flowmeter and upstream of the filling valve, wherein the pressure enhancing element is configured to force the pourable product through a pressure enhancing element diameter that is smaller than a diameter of the duct, the method comprising:

feeding the pourable product contained in the tank via the duct to the filling valve and controlling the filling valve to control filling of the container with the pourable product, wherein the vortex flowmeter located inside the duct includes an inlet mouth, an outlet mouth, and an obstacle situated between the inlet mouth and outlet mouth and configured to create a train of vortices in the pourable product flowing through the duct;

based on the tank pressure, the pressure enhancing element, and the duct, pressurizing the outlet mouth of the vortex flowmeter to be at least 5 times greater than a hydraulic head between the inlet and outlet mouths of the vortex flowmeter;

while the pourable product having the electrical conductivity below 15 μS flows through the vortex flowmeter having pressure at the outlet mouth thereof that is at least 5 times greater than the hydraulic head between the inlet and outlet mouths thereof, measuring a frequency of the vortices in the pourable product created by the obstacle and calculating a flow rate of the pourable product flowing along the duct based on the frequency of the vortices; and filling the container with the pourable product via the filling valve, wherein the filling valve is controlled based on the calculated flow rate of the pourable product.

8. The method according to claim 7, further including:

conveying the pourable product through a first lineariser device disposed within the duct at a position upstream of the vortex flowmeter; and conveying the pourable product through a second lineariser device disposed within the duct at a position downstream of the vortex flowmeter.

9. The method according to claim 8, wherein at least one of the first lineariser device or the second lineariser device includes a plurality of openings arranged symmetrically about an axis of the duct.

10. The method according to claim 7, wherein the pressure enhancing element is a first throttling disposed within the duct between the vortex flowmeter and the filling valve.

11. The method according to claim 10, wherein the duct additionally includes a second throttling disposed within the duct between the vortex flowmeter and the first throttling, the second throttling configured to force the pourable product through a diameter of the second throttling that is smaller than the diameter of the duct.

12. The method according to claim 11, wherein filling the container with the pourable product comprises:

conveying the pourable product through the first throttling and along a path bypassing the second throttling to fill the container at a first filling rate; and conveying the pourable product through the first throttling and through the second throttling to reduce the flow rate of the pourable product to fill the container at a second filling rate, wherein the first filling rate is greater than the second filling rate, and wherein the first throttling is configured to maintain the flow rate of the pourable product through the second throttling to be equal to or less than a maximum flow rate.

13. The method according to claim 12, wherein the first throttling and the second throttling are cylindrical, and wherein the diameter of the first throttling is greater than the diameter of the second throttling.

14. A filling system for filling a container with a pourable product having electrical conductivity below 15 μS, the filling system comprising:

a tank configured to hold the pourable product at a tank pressure between 0.6 bars and 1.4 bars;

a filling valve configured to selectively allow filling of the container with the pourable product;

a duct interposed between the tank and the filling valve;

a vortex flowmeter disposed within the duct, the vortex flowmeter comprising:

an inlet mouth, an outlet mouth, at least one obstacle situated between the inlet mouth and outlet mouth, the obstacle configured to create a train of vortices in the pourable product flowing through the duct, and a sensor located downstream of the obstacle and configured to detect the frequency of the vortices created by the obstacle;

a pressure enhancing element interposed within the duct downstream of the outlet mouth of the vortex flowmeter and upstream of the filling valve, wherein the pressure enhancing element is configured to force the pourable product through a pressure enhancing element diameter that is smaller than a diameter of the duct, and wherein the tank pressure, the pressure enhancing element, and the duct are configured to create a pressure at the outlet mouth of the vortex flowmeter that is at least 5 times greater than a hydraulic head between the inlet and outlet mouths of the vortex flowmeter; and a control unit configured to:

while the pourable product having the electrical conductivity below 15 μS flows through the vortex flowmeter having the pressure at the outlet mouth thereof that is at least 5 times greater than the hydraulic head between the inlet and outlet mouths thereof, calculate a flow rate of the pourable product based on the frequency of the vortices in the pourable product detected by the sensor, and actuate the filling of the container with the pourable product by the filling valve based, at least in part, on the calculated flow rate.

15. The filling system according to claim 14, further comprising:

a first lineariser device disposed within the duct at a position upstream of the vortex flowmeter; and a second lineariser device disposed within the duct at a position downstream of the vortex flowmeter.

16. The filling system according to claim 15, wherein at least one of the first lineariser device or the second lineariser device includes a plurality of openings arranged symmetrically about an axis of the duct.

17. The filling system according to claim 14, wherein the pressure enhancing element is a first throttling disposed within the duct between the vortex flowmeter and the filling valve.

18. The filling system according to claim 17, further comprising:

a second throttling disposed within the duct between the vortex flowmeter and the first throttling, the second throttling configured to force the pourable product flowing along the duct through a diameter of the second throttling that is smaller than the diameter of the duct; and a bypass valve configured to be displaced between:

a first position, in which the bypass valve is configured to guide the pourable product to pass through the first throttling and to bypass the second throttling so as to fill the container with the pourable product at a first filling rate, and a second position, in which the bypass valve is configured to force the pourable product to pass through the first throttling and to pass through the second throttling so as to fill the container with the pourable product at a second filling rate, wherein the first filling rate is greater than the second filling rate, and wherein when the bypass valve is arranged in the second position, the first throttling is configured to maintain the flow rate of the pourable product through the second throttling to be equal to or less than a maximum flow rate.

19. The filling system according to claim 18, wherein the first throttling and the second throttling are cylindrical, and wherein the diameter of the first throttling is greater than the diameter of the second throttling.

* * * * *